US007612315B2

(12) United States Patent
Corradini

(10) Patent No.: US 7,612,315 B2
(45) Date of Patent: Nov. 3, 2009

(54) SYSTEM FOR CONTROLLING HUMIDITY

(75) Inventor: Franco Corradini, Modena (IT)

(73) Assignee: Angelo Po' Grandi Cucine -- Societa' per Azioni, Carpi (MO) (IT)

( * ) Notice: Subject to any disclaimer, the term of this patent is extended or adjusted under 35 U.S.C. 154(b) by 45 days.

(21) Appl. No.: 11/392,527

(22) Filed: Mar. 30, 2006

(65) Prior Publication Data

US 2006/0289507 A1 Dec. 28, 2006

(30) Foreign Application Priority Data

Jun. 22, 2005 (IT) ..... MO2005A0159

(51) Int. Cl.
*G01R 27/26* (2006.01)
*H01G 5/16* (2006.01)
*A21B 1/24* (2006.01)

(52) U.S. Cl. ..... 219/401; 219/413; 219/497; 324/664; 324/665; 324/667; 324/689; 126/20

(58) Field of Classification Search ..... None
See application file for complete search history.

(56) References Cited

U.S. PATENT DOCUMENTS 3,557,334 A * 1/1971 Lewis ..... 219/693
4,516,012 A * 5/1985 Smith et al. ..... 219/400
4,683,904 A * 8/1987 Iltis ..... 137/78.3
5,272,963 A * 12/1993 Del Fabbro ..... 99/468
5,525,782 A * 6/1996 Yoneno et al. ..... 219/682
5,676,051 A * 10/1997 Sinemus ..... 99/476
6,157,006 A * 12/2000 Sickles et al. ..... 219/401
6,369,362 B1 * 4/2002 Brenn ..... 219/401
6,373,264 B1 * 4/2002 Matsumoto et al. ..... 324/667
6,784,673 B2 * 8/2004 Tomasi et al. ..... 324/664
6,914,226 B2 * 7/2005 Ottaway ..... 219/775
6,987,246 B2 * 1/2006 Hansen et al. ..... 219/401
7,235,762 B2 * 6/2007 Gagas et al. ..... 219/400
7,343,850 B2 * 3/2008 Gerl ..... 99/332
2004/0016744 A1 * 1/2004 Ottaway ..... 219/399
2004/0103794 A1 * 6/2004 Shon et al. ..... 99/330
2007/0039488 A1 * 2/2007 Hunter et al. ..... 99/476
2007/0187388 A1 * 8/2007 Yamaguchi et al. ..... 219/401

* cited by examiner

*Primary Examiner*—Joseph M Pelham
(74) *Attorney, Agent, or Firm*—Nixon & Vanderhye P.C.

(57) ABSTRACT

An apparatus for cooking foods comprises a cooking chamber provided with humidity-detecting device arranged in such a way as to detect the humidity in said cooking chamber, wherein said humidity-detecting device comprises a capacitive sensor; a system for controlling the humidity in a chamber for cooking foods comprises a humidity detecting device provided with a capacitive sensor.

33 Claims, 6 Drawing Sheets

SYSTEM FOR CONTROLLING HUMIDITY

This application is a new U.S. application claiming priority to IT MO2005A000159 filed 22 Jun. 2005, the entire contents of which are hereby incorporated by reference.

The invention relates to a system for controlling humidity inside a chamber in which a foods product is subjected to a heat-treatment process, for example a chamber for cooking such a product, the product may be solid or liquid.

The invention furthermore relates to an apparatus for cooking foods provided with the aforementioned system for controlling the humidity.

Systems are known for controlling humidity inside a chamber for cooking a foods product, which comprise a humidity detecting device that measures the humidity in the cooking chamber and a controlling device, that enables the cooking process to be controlled on the basis of the measured humidity value, for example by driving a boiler to generate steam, or by driving an outlet valve for a primary operating fluid, such as for example air or a mixture of air and steam, present in the chamber, in such a way as to keep the humidity in the chamber at a preset value.

The humidity detecting device of known systems generally measures humidity in an indirect manner, i.e. by measuring a parameter other than the humidity, generally a physical parameter, referable to the humidity value, for example by means of known or empirical physical laws.

U.S. Pat. No. 5,694,835 discloses a system of the aforementioned type in which the detecting device for detecting the humidity inside a cooking chamber consists of a zircon oxide probe that, by facing a cooking chamber of a cooking apparatus, measures the concentration of oxygen in the mixture of gases present in the cooking chamber. In the event that only oxygen, nitrogen and steam are present in the cooking chamber and assuming that the ratio between oxygen and nitrogen is constant, the concentration of oxygen provides a measurement of the concentration of steam and therefore a measurement of the humidity present in the cooking chamber.

A drawback of the system disclosed in U.S. Pat. No. 5,694,835 is that it is scarcely reliable for the operating temperature of the cooking apparatus.

Furthermore, the zircon oxide probe has to be replaced rather frequently, thus increasing cooking time and costs of maintenance of the apparatus.

Another drawback is that the zircon oxide probe can be damaged by the substances that are normally used for cleaning the cooking chamber.

A further system for controlling humidity is disclosed in DE 4206845. In this case, the system measures the pressure difference in a gaseous mixture between two preset points in a rotor arranged to generate vortices inside a cooking chamber. From the pressure difference it is possible to know the density of the gaseous mixture and from the latter to obtain the concentration of each of the components of the gaseous mixture, in particular of the steam, in such a way as to obtain the humidity value in the cooking chamber.

The system disclosed in DE 4206845, although it is quite accurate, is rather costly.

Apparatuses for cooking foods of the known type are provided with a circulation system of a primary operating fluid, for example air or a mixture of air and steam. The circulation system comprises a dispensing opening, located in an end zone of a wall of the cooking chamber, through the dispensing opening the primary operating fluid enters the cooking chamber by the action of a fan device acting on the primary operating fluid.

A drawback of known apparatuses for cooking foods is that the primary fluid takes a certain time to enter the cooking chamber, thus entailing a delay in the stabilisation within preset values of the parameters on which the cooking process depends, such as, for example, temperature, humidity, pressure.

An object of the invention is to improve the systems for controlling humidity inside a cooking chamber of foods products.

Another object is to provide an apparatus for cooking foods products provided with a system for controlling humidity that is reliable even when subjected to relatively high cooking temperatures.

Still another object is to obtain a device for detecting humidity inside a cooking chamber that is constructionally simple and has a reduced cost.

A further object is to provide a cooking apparatus in which the conditions in the cooking chamber reach, in a relatively fast manner, the preset or desired conditions, requested for example by a controlling device of the cooking process.

Still a further object is to obtain an apparatus for cooking foods in which a primary operating fluid can enter a cooking chamber in an easy manner.

In a first aspect of the invention, an apparatus is provided for cooking foods, comprising a cooking chamber provided with a humidity-detecting device arranged in such a way as to detect the humidity in said cooking chamber, wherein said humidity-detecting device comprises a capacitive sensor.

Owing to the capacitive sensor it is possible to obtain a measurement of the humidity in the cooking chamber that is also reliable at the temperatures normally reached in the cooking chamber.

Furthermore, the capacitive sensor is easy to make and has a limited cost.

In a second aspect of the invention an apparatus is provided for cooking foods, comprising a circulating arrangement arranged for introducing and/or extracting a primary operating fluid intended to cook said foods in and/or from a cooking chamber, wherein a flow promoting device is further provided arranged for promoting the flow of said primary operating fluid from said circulating arrangement to said cooking chamber.

In a version the apparatus comprises a humidity-detecting device arranged for detect the humidity of said cooking chamber.

In a further version the humidity-detecting device comprises a capacitive sensor.

In still further versions the apparatus can still comprise a processing unit for processing the output signal from the humidity-detecting device, a nebulizer for nebulizing the incoming water, a heat exchanger for vaporising the incoming water.

In a third aspect of the invention a system for controlling the humidity in a chamber comprising a humidity detecting device comprising a capacitive sensor it is provided for.

In a version, the system further comprises a flow promoting device arranged for promoting the flow of a primary operating fluid from a circulating arrangement to a chamber.

In a further version the chamber comprises a cooking chamber.

Owing to the flow promoting device, the time taken by the primary operating fluid to enter the cooking chamber is significantly reduced compared with prior-art apparatuses.

This thus enables an apparatus for cooking foods to be obtained in which the cooking conditions detected at a given instant adapt rapidly to preset or desired cooking conditions.

The invention will be better understood and implemented with reference to the attached drawings that illustrate certain embodiments thereof by way of non-limitative example, in which.

Figure 1:
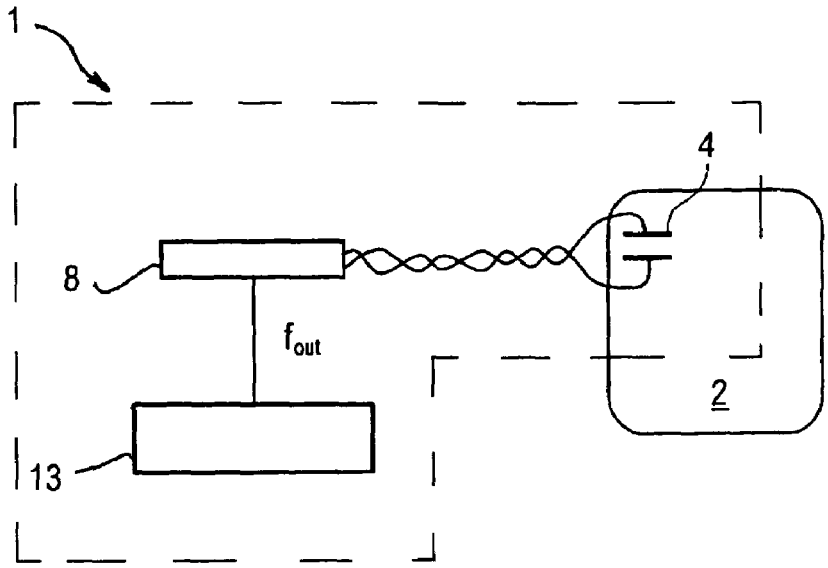
FIG. 1 is a diagram showing a humidity detecting device associated with a cooking chamber during a heat-treatment cycle of a foods product, this detecting device comprising a capacitive sensor placed inside the cooking chamber.

In FIG. 1 a humidity detecting device 1 is shown, indicated by a broken line, in a cooking apparatus 3 arranged for cooking solid or liquid foods introduced into a chamber 2 of the cooking apparatus 3.

For cooking the foods in the cooking apparatus 3, a primary operating fluid, in particular hot air or a mixture of air and of steam, for example saturated or overheated steam, is forced to circulate inside the chamber 2. The cooking process is controlled by measuring and regulating numerous parameters, for example the temperature and humidity in the chamber 2 and the speed of flow of the primary operating fluid. It is also known that the foods release steam inside the chamber 2, during cooking thereof. Thus, humidity in combination with temperature plays and important role in the quality of the cooking process, influencing both cooking time and the appearance of the foods when they have been cooked, and their taste and consistency.

Figure 3:
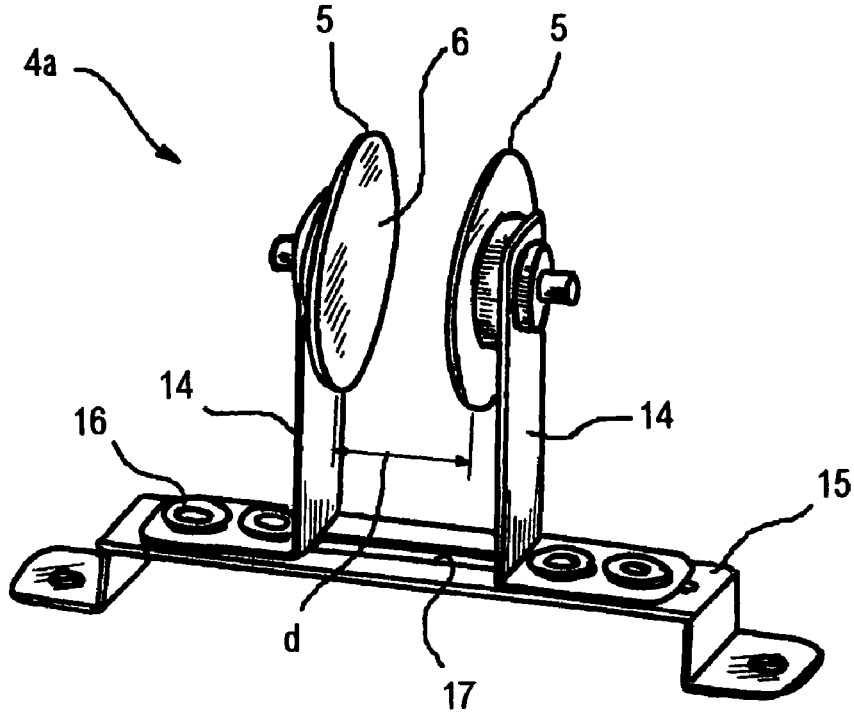
FIG. 3 is a perspective view of the capacitive sensor provided in the humidity detecting device in FIG. 1.

The humidity detecting device 1 comprises a capacitive sensor 4, a particular embodiment of the capacitor type 4*a* of which is shown in FIG. 3. The capacitor 4*a* is provided with two plates 5 facing and arranged at a reciprocal distance d. Each plate 5 has a circular shape and is sustained by a substantially "L"-shaped support 14 connected to a support element 15 that is fixed to a wall of the chamber 2 by means of screws or bolts that are not shown.

The position of each support 14 is adjustable on the support element 15. Connecting members that are not shown enable holes 16 obtained on the side of the "L" in contact with the support element 15 to be connected to a slot 17 obtained on the support element 15.

In an alternative embodiment the two plates 5 may have a different shape from the circular shape, for example they may have a plan shape that is the same as a geometrical figure, such as a rectangle, or a square or a regular polygon.

Figure 4:
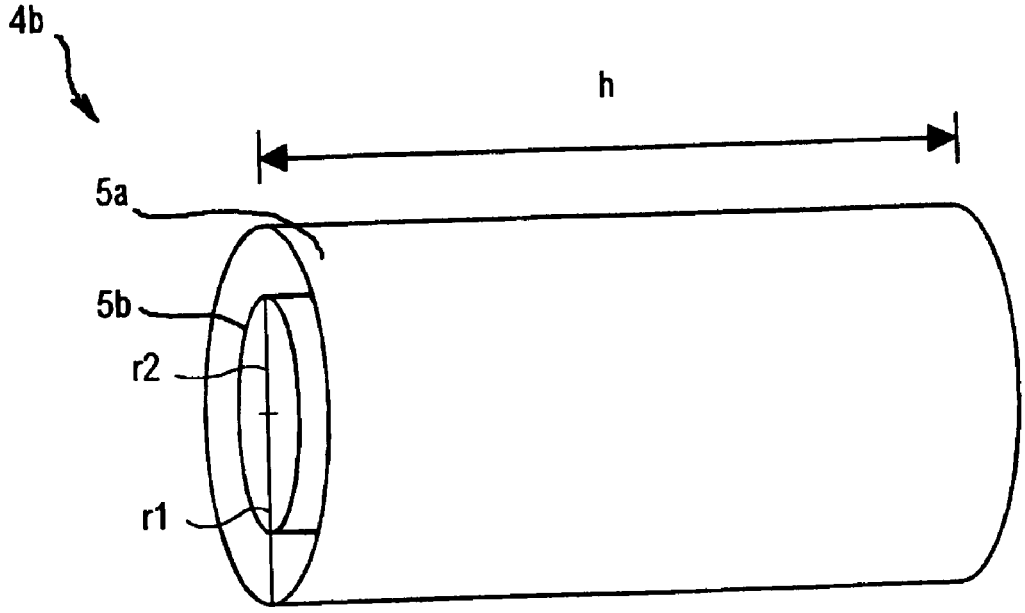
FIG. 4 is a perspective schematic view of another embodiment of the capacitive sensor.

In a further alternative embodiment shown in FIG. 4, the plates 5 may be two cylindrical armatures, an external armature 5*a* and an internal armature 5*b*, that are substantially concentric and are arranged at a given radial distance and have a preset length h.

As is known, the electric capacity C of the capacitor 4*a* in FIG. 3 is linked to the dimensional features of the plates 5 according to the law:

$$C=\in^{*}A/d$$

where $\in$ is the dielectric constant of the material interposed between the plates 5, A and the area of the facing surfaces 6 of the plates 5 and d is the distance between the plates 5. By maintaining the area of the surface A and the distance d constant, a variation of the material comprised between the plates 5 implies a variation of the electric capacity C.

If there is a fluid between the plates 5 such as, for example, air, having a dielectric constant $\in_1$, the capacitor 4*a* has a certain capacity value $C_1$. If between the plates 5 there is a mixture of air and steam, for example saturated or overheated steam, the dielectric constant of the fluid is different from $\in_1$ and depends on the fraction of steam present in the mixture, consequently also the capacity C of the capacitor is different from $C_1$. The variation in the capacity C of the capacitor 4 is used as a measurement of the variation of the concentration of steam and therefore of the humidity present in the chamber 2.

In the embodiment in FIG. 4, the capacity depends on the geometrical structure of the capacitor 4*b* through the known law:

$$C=2\pi\in^{*}h/ln(r_1/r_2),$$

where $r_1$ is the radius of the external armature 5*a* and $r_2$ is the radius of the internal armature 5*b*.

In an embodiment that is not shown, between the plates 5, or the cylindrical armatures 5*a*, 5*b*, a material can be interposed that is sensitive to steam, for example a hygroscopic material. Such a material, being traversed by the primary operating fluid, makes the humidity detecting device 1 more sensitive to steam and increases the accuracy of the measurement of the detected humidity. The interposed material also has excellent resistance to the operating temperatures of the cooking apparatus, for example of about 300° C.

Figure 2:
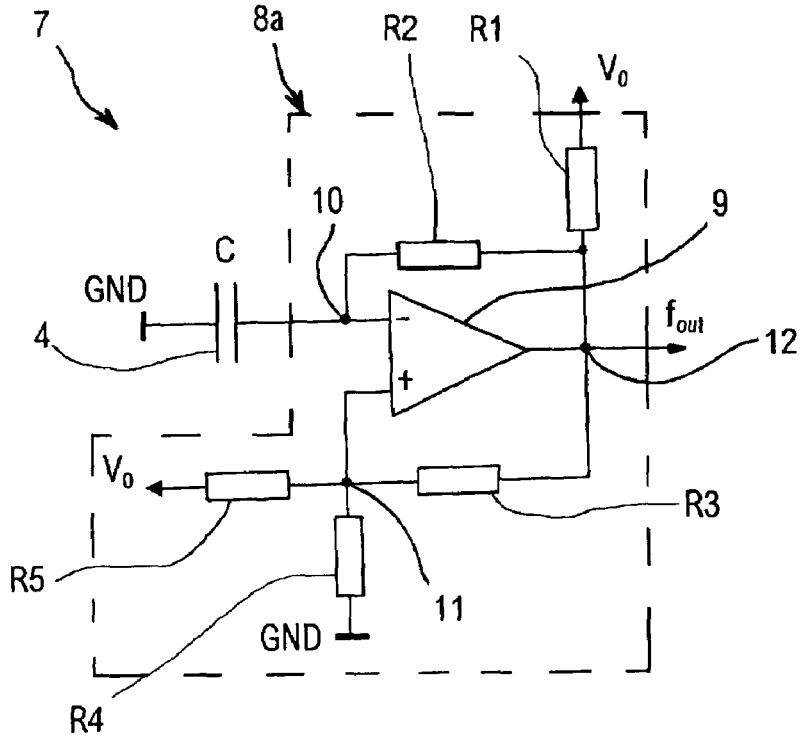
FIG. 2 is a diagram of an oscillating circuit provided in said humidity detecting device.

As illustrated in FIGS. 1 and 2, the electric capacity C is converted into a frequency signal, by means of an oscillating circuit 7 in which the capacitive sensor 4 is inserted, this oscillating circuit 7 having an oscillation frequency $f_{out}$ that is detectable by an output terminal 12. The frequency $f_{out}$ depends on the variation of the capacity C.

The oscillating circuit 7 comprises a comparator circuit 8 and the capacitive sensor 4. In the embodiment in FIG. 2, the comparator circuit 8*a*, indicated by a broken line, is provided with a voltage difference indicator 9, for example of the LM311 type, to which at a first input 10 a plate of the capacitor 4 is connected. The other plate of the capacitor 4 is earthed.

The voltage difference indicator 9 is supplied with voltage $V_0$ both on the first input 10, through resistances $R_1$ and $R_2$, and on a second input 11 through resistances $R_3$ and $R_5$, arranged according to the pattern of FIG. 2. The second input 11 is then earthed through a further resistance $R_4$.

The resistances provided in the oscillating circuit 7 have the following values: $R_1$=450 ohm; $R_2$=1 Mohm; $R_3$=$R_4$=$R_5$=9,9 kohm. On the output terminal 12 the voltage difference indicator 9 provides a certain voltage $V_{out}$.

The output terminal 12 is then connected to a frequency meter or a timer 13, that enables the frequency $f_{out}$ to be measured with which the voltage difference indicator 9 switches.

The measurement of the frequency $f_{out}$, or of the period of the wave shape, at the outlet 12 from the voltage difference indicator 9 provides, in an indirect manner, a measurement of the variation of the dielectric constant of the fluid present between the plates 5 of the capacitor 4.

When a voltage is applied to the second input 11 that is greater than that applied to the first input 10, the output terminal 12 has a voltage $V_0$. On the other hand, when a voltage is applied to the second input 11 that is less than the voltage applied to the first input 10, the output terminal 12 reaches the earth GND voltage value.

In the configuration in FIG. 2, in which the resistances $R_3$, $R_4$ and $R_5$ are the same as one another, when voltage $V_0$ is applied to the output terminal 12, the voltage $(2/3)V_0$ is applied to the second input 11. In this condition a capacitor 4 charging phase starts, during which the voltage on the first input 10 increases. When the voltage on the first input 10 exceeds the value $(2/3)V_0$ the output terminal 12 switches to the GND value. As a result, the voltage on the second input 11 lowers to $(1/3)V_0$. A phase of discharging phase of the capacitor 4 then occurs that terminates when the voltage on the first input 10 is less than $(1/3)V_0$. In this case, the output terminal 12 of the voltage difference indicator 9 switches again to the value $V_0$ and the second input 11 returns to the voltage $(2/3)V_0$. The resistances $R_3$, $R_4$ and $R_5$ are selected in such a way as to set the switching levels of the voltage difference indicator 9. The resistance $R_2$ is used for the charging and discharging phases of the capacitor 4. Some of the resistances of the oscillating circuit 7 can also be variable resistances.

The frequency signal thereby obtained is transmitted to a processing unit provided in the system for controlling humidity. Inside the processing unit a processing logic is housed that processes this signal. In particular, with each frequency signal value obtained, the processing logic associates a humidity value of the primary operating fluid in the chamber 2 using a suitable algorithm that is able to mediate, filter and correct the read values so as to obtain the most accurate value possible.

Figure 5:
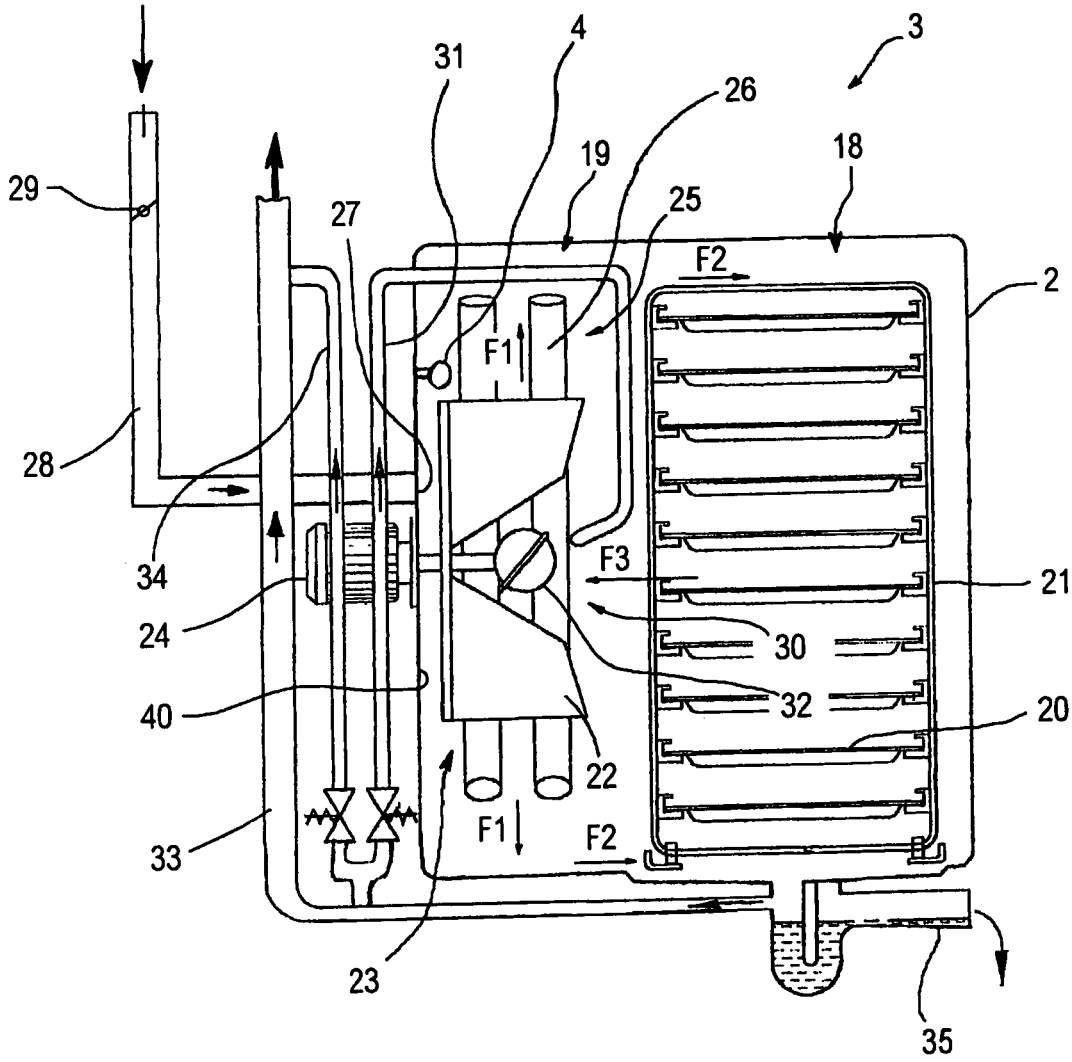
FIG. 5 is a sectioned schematic view of a cooking apparatus comprising the humidity detecting device in FIG. 1.

In FIG. 5 there is shown the cooking apparatus 3 comprising a monitoring system of the humidity in which the humidity detecting device 1 is arranged. The chamber 2, having a substantially parallelepipedon shape, comprises a cooking zone 18, in which the foods are ordered on trays 20 arranged near a structure 21, and a heating zone 19, adjacent to the cooking zone 18.

In the heating zone 19 there is situated a centrifugal rotor 22 of a fan 23 driven by a motor 24.

On the edge of the rotor a heat exchanger 25 is arranged that is provided with an assembly of pipes 26, inside which an operating fluid flows, for example combustion gas produced by a fuel gas burner that is not shown.

Alternatively, the heat exchanger may comprise a series of electrical resistances.

An opening 27 obtained in a wall of the chamber 2 in the heating zone 19 enables the entry of air from a supply conduit 28 connected to an environment outside the chamber 2 by means of a valve 29. The air originating from the supply conduit 28, after being heated by the heat exchanger 25, is pushed in a centrifugal direction indicated by the arrows F1 in FIG. 6 through the rotating action of the centrifugal rotor 22 and is subsequently diverted into the cooking zone 18 in a direction indicated by the arrows F2.

After transferring heat to the foods in the cooking zone 18, the air is sucked from the centrifugal rotor 22 to an axial inlet of the fan 23 in a direction F3.

To the shaft of the centrifugal rotor 22 a spraying device 30 is connected comprising a spherical element 32 that is used to spray a jet of water coming from an inlet conduit 31 and that extends into the chamber 2 as far as the spherical element 32.

The chamber 2 furthermore comprises an outlet pipe 33 for the outlet of the primary operating fluid from the chamber 2 to which a water delivery conduit 34 is connected.

Finally, in a bottom portion of the cooking zone a discharge conduit 35 is provided from which cooking residues are removed from the chamber 2, such as, for example, fats or oils.

In the embodiment in FIG. 5, the capacitor 4 is mounted on a wall 40 of the chamber 2 in which the opening 27 is also received. The plates 5 of the capacitor 4 are arranged so as to be traversed by the flow of the primary operating fluid moved by the fan 23, i.e. they are substantially parallel to the direction F1.

In an embodiment that is not shown, the humidity detecting device 1 is of the type with concentric cylindrical armatures, according to the embodiment in FIG. 4, arranged in the heating zone 19. In this version, the cylindrical armatures are arranged in such a way that the length h is substantially parallel to the movement direction of the primary operating fluid, i.e. parallel to the direction F1.

During the cooking process, the detecting device 1 measures the humidity in the chamber 2 and sends a signal to the processing unit that is located outside the chamber 2 so as to be monitored by an operator. From the comparison with the detected humidity value and a preset reference humidity value, the processing unit controls the operation of an adjusting device that enables the measured humidity value to be adjusted so as to take it to the reference value. This adjusting device may comprise the valve 29 for delivering air into the chamber 2, a speed variator for varying the rotation speed of the centrifugal rotor 22, a temperature adjuster, the spraying device or other. If, for example, the humidity detected is greater than the reference value, the processing unit operates the opening of the valve 29, to enable substantially only air to be introduced into the chamber 2. On the other hand, if the humidity in the chamber 2 is less than the reference value the processing unit operates the spraying device 30.

The control logic of the cooking apparatus 3 thus manages the functions of delivery of water and air, and the expulsion of the air and steam mixture, so as to maintain in the chamber 2 the humidity value set by the operator.

An advantage of using a capacitor 4 is that the detecting device is constructionally simple and of limited cost.

Furthermore, if the material of the plates 5 of the capacitor 4 is, for example, steel, the humidity detecting device 1 is reliable and very resistant to the strong temperature variations that may occur inside a cooking chamber.

The particular shape of the capacitor 4 enables easy cleaning of the latter, even if it is soiled by cooking residues.

The capacitive sensor 4 is positioned directly inside the chamber 2 in a region in which the flow of the primary operating fluid is indicative of the flow that laps on the trays 20. Furthermore, the humidity detecting device 1 is easily accessible by an operator for possible maintenance operations.

Figure 6:
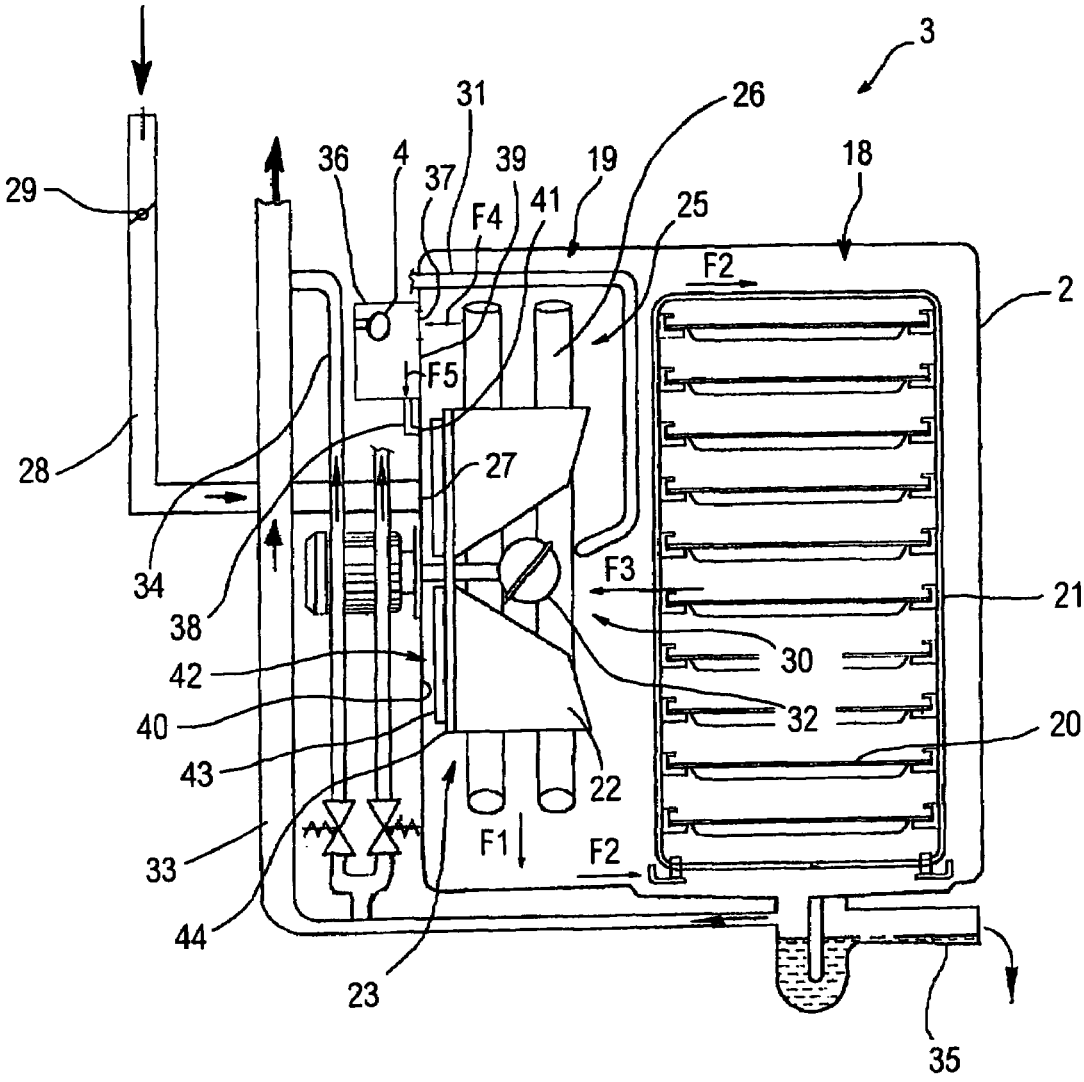
FIG. 6 is a schematic view like the one in FIG. 5 showing an embodiment of the cooking apparatus provided with flow promoting device arranged to accelerate the entry of a primary operating fluid into the cooking chamber.

An alternative embodiment of the cooking apparatus 3 is shown in FIG. 6, in which the capacitive sensor 4 is located inside a further chamber 36 adjacent to the heating zone 19. The further chamber 36 is connected to the chamber 2 through a first passage 37 obtained in a portion of common wall 39 and a second passage 38 comprising a conduit that from the further chamber 36 ends in a hole 41 obtained on the wall 40 of the chamber 2.

The primary operating fluid is moved to traverse the first passage 37 and the second passage 38 in the directions indicated by the arrows F4 and F5 through the effect of a suction action exerted by a flow promoting device 42. The flow promoting device 42 comprises a set of blades 43 mounted on the rotation shaft of the centrifugal rotor 22.

Figure 9:
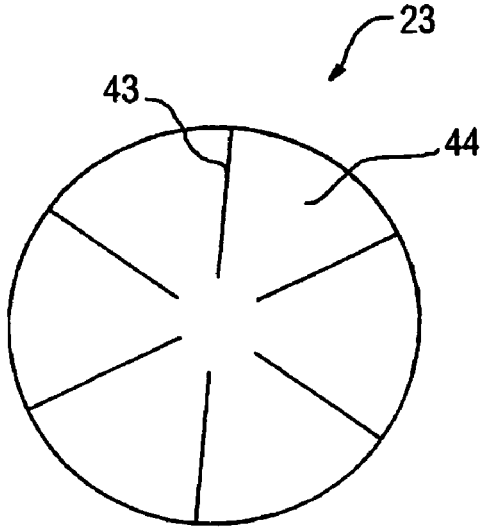
FIG. 9 is a schematic frontal view of the flow promoting device of FIG. 6.

As shown in FIG. 9, the blades 43 extend radially from a central zone to a periphery of the centrifugal rotor 22, the blades 43 being mounted on a disc 44 of the fan 23 on a side opposite centrifugal blades of the rotor 22.

In FIG. 9 there are shown six blades 43 arranged at a constant angular pitch. In an embodiment that is not shown, the number of blades 43 can be other than six.

The hole 41 is arranged at a peripheral region of the blades 43, so that during rotation, at each movement of the blades 43 near the hole 41 a vacuum is generated that promotes the passage of the primary operating fluid from the further chamber 36 to the chamber 2 through the second passage 38.

As a result, the primary operating fluid leaving the further chamber 36 causes new fluid to enter from the chamber 2 into the further chamber 36.

The flow promoting device 42 ensures that the flow into the further chamber 36 substantially corresponds to the flow present in the cooking zone 18.

Furthermore, as the blades 43 during rotation furthermore pass near the opening 27, the flow promoting device 42 enables air to be sucked by the supply conduit 28 in a more effective manner than is the case when they are not present.

This enables the cooking parameters to be regulated in a faster manner, thus limiting the duration of transitional periods during which the various adjusting devices of the cooking conditions are driven by the processing unit to make the conditions in the cooking chamber to correspond to the conditions that it is desired to obtain.

The flow regulating device 42 can also be present in the embodiment in FIG. 5. In this case, it performs the sole function of increasing the speed of the air entering the chamber 2 from the supply conduit 28.

Figure 7:
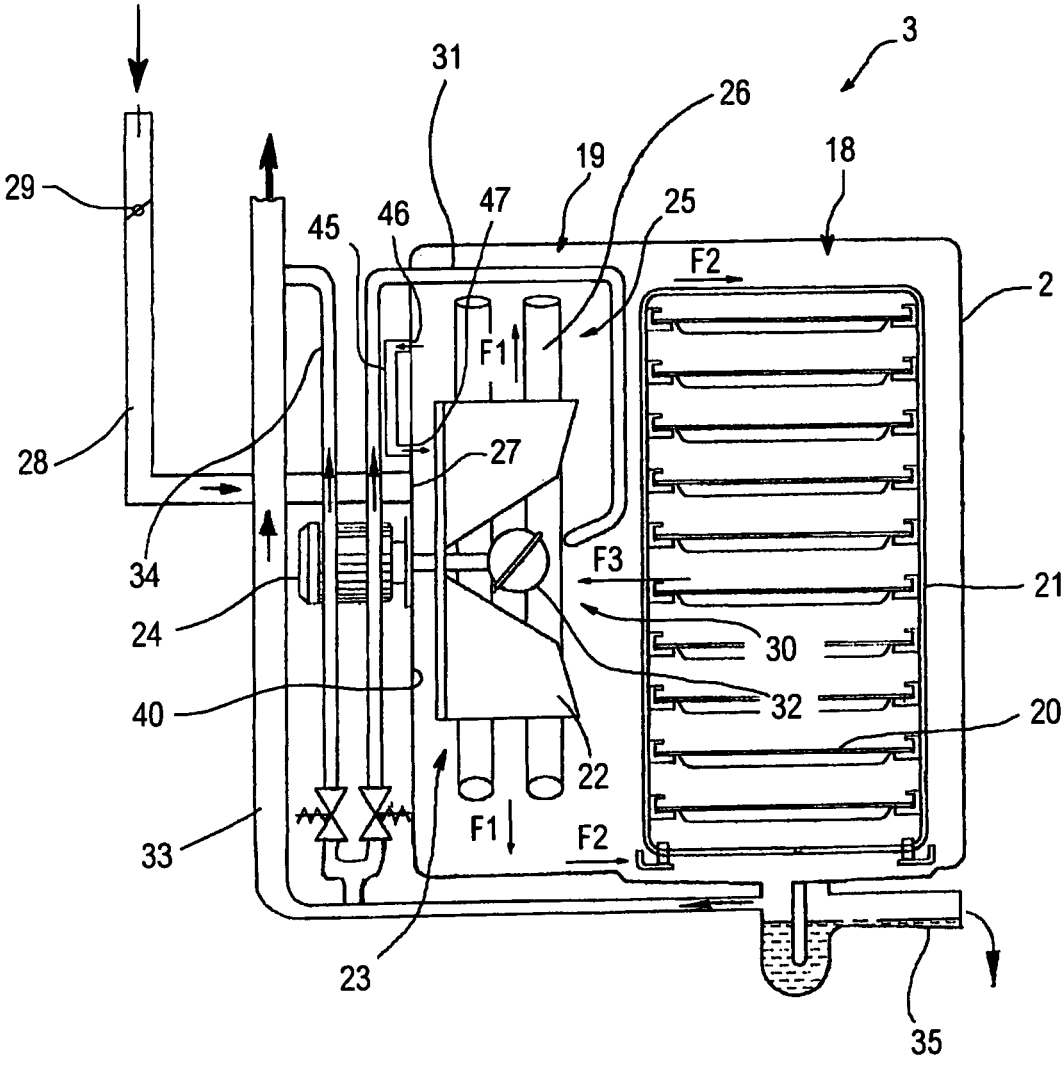
FIG. 7 is a view like the one in FIG. 5 showing a further embodiment of the cooking apparatus provided with a humidity detecting device.

Another embodiment of the cooking apparatus is shown in FIG. 7, in which instead of the further chamber 36 a further conduit 45 is provided that is traversed by primary operating fluid coming from the chamber 2 through a first opening 46 that is further away from the opening 27. The primary operating fluid from the further conduit returns to the chamber 2 through a second opening 47 nearer the opening 27. The first opening 46 is obtained on the wall 40 in a zone in which the primary operating fluid has already adopted a centrifugal movement, whereas the second opening 47 is obtained on the wall 40 in a zone nearer the axis of the fan 23. The humidity detecting device 1, that is not shown, is arranged in such a way that the capacitive sensor 4 is positioned inside the further conduit 45, so that the space between the plates 5, or between the armatures 5*a* and 5*b*, is traversed by the primary operating fluid when it traverses the further conduit 45.

Figure 8:
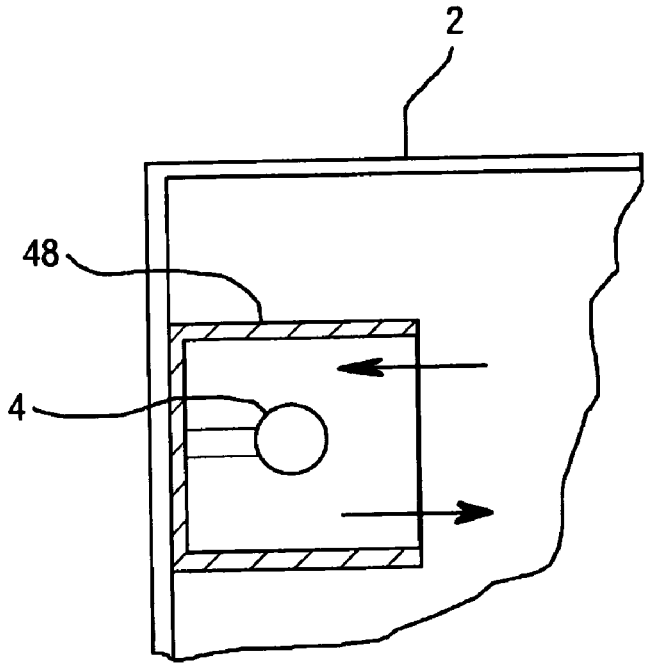
FIG. 8 is a detailed view of a version of the cooking apparatus.

With reference to FIG. 8, there is shown an embodiment of the cooking apparatus 3 in which the capacitive sensor 4 is located in a dedicated zone of the chamber 2 provided with screen elements 48. The screen elements 48 comprise a plurality of walls arranged so as to protect the humidity detecting device 1 from possible turbulent movements of the primary operating fluid that could influence variation of the capacity of the capacitor 4 in an anomalous manner.

The cooking apparatus 3 comprises, in all the embodiments in FIG. 5, FIG. 6, FIG. 7 and FIG. 8, a device for detecting the temperature in the chamber 2 that is not shown.

Furthermore, the cooking apparatus 3 may comprise, in all the illustrated embodiments, a temperature detector for detecting the temperature in a zone near the capacitor 4.

Such devices, which are not shown, together with the heat exchanger 25, are controlled by the processing unit and are driven when the detected parameters of the cooking process have values that do not correspond to values that are set or are settable by a user.

Controlling the temperature, the flow speed of the primary operating fluid together with controlling the humidity thus enable the quality of the cooking process to be controlled.

In an embodiment that is not shown, a plurality of capacitors 4 can be provided located at points of the chamber 2 that are distinct from one another or in apposite cavities adjacent to the chamber 2. In this embodiment, each capacitor is connected to a comparator circuit 8 and the frequency signal leaving each oscillator 7 is processed by the processing unit, that proceed to command a suitable adjusting device.

The invention claimed is:

1. Apparatus for cooking foods, said apparatus having operative temperatures higher that 100° C. and comprising a cooking chamber provided with a humidity-detecting device arranged in such a way as to detect the humidity in said cooking chamber, said humidity-detecting device comprising a capacitive sensor and a comparator circuit arrangement electrically connected to said capacitive sensor to form an oscillating circuit, said capacitive sensor comprising a pair of armatures facing each other and placed at a defined distance that is adjustable.

2. Apparatus according to claim 1, wherein said oscillating circuit is arranged for converting a capacity variation of said capacitive sensor into an electric frequency variation.

3. Apparatus according to claim 1, wherein said oscillating circuit is connected to a frequency-measuring device such as to measure said frequency variation and to provide a value of said frequency variation.

4. Apparatus according to claim 1, wherein said oscillating circuit is connected to a timing device such as to measure the period of the output signal from the oscillating circuit and to provide a variation value of said period.

5. Apparatus according to claim 3, and further comprising a processing unit such as to process said value to associate it with a humidity value.

6. Apparatus according to claim 1, wherein each armature of said pair of armatures is of steel.

7. Apparatus according to claim 1, wherein each armature of said pair of armatures is flat and has a plan shape chosen from a group of geometrical figures comprising: a circle, a regular polygon, an irregular polygon, a rectangle, a square.

8. Apparatus according to claim 1, wherein said pair of armatures comprises a pair of concentric cylindrical radially spaced armatures that are radially spaced.

9. Apparatus according to claim 1, and further comprising a humidity generator arrangement arranged to increase the humidity in said cooking chamber.

10. Apparatus according to claim 5, and further comprising a humidity generator arrangement arranged to increase the humidity in said cooking chamber.

11. Apparatus according to claim 10, wherein said humidity generator arrangement is controlled by said processing unit.

12. Apparatus according to claim 1, and further comprising a circulating arrangement arranged for introducing and/or extracting a primary operating fluid intended to cook said foods in and/or from said cooking chamber.

13. Apparatus according to claim 5, and further comprising a circulating arrangement arranged for introducing and/or extracting a primary operating fluid intended to cook said foods in and/or from said cooking chamber.

14. Apparatus according to claim 13, wherein said circulating arrangement is provided with a flow regulating device arranged to regulate the introduction and/or the extraction of said primary operating fluid, said flow regulating device being controlled by said processing unit.

15. Apparatus according to claim 12, wherein said capacitive sensor is arranged in a zone intended to be traversed by a current of said primary operating fluid, said current being indicative of a further current of said primary operating fluid near said foods.

16. Apparatus according to claim 15, wherein plates of said capacitive sensor are arranged substantially parallel to a direction identified by said current.

17. Apparatus according to claim 15, wherein said capacitive sensor is housed in said zone, said zone being provided inside said chamber.

18. Apparatus according to claim 15, wherein said zone is provided in a further chamber adjacent to said cooking chamber.

19. Apparatus according to claim 15, wherein said zone is obtained in a conduit outside said cooking chamber that connects two zones of said cooking chamber.

20. Apparatus according to claim 15, wherein in said zone screen elements are further provided arranged to protect said capacitive sensor.

21. Apparatus according to claim 12, and further comprising a flow promoting device arranged to promote a flow of said primary operating fluid from said circulating arrangement to said cooking chamber.

22. Apparatus according to claim 1, wherein near said capacitive sensor a temperature sensor is provided to detect the temperature in said cooking chamber.

23. Apparatus according to claim 1, and further comprising a plurality of capacitive sensors located in distinct zones of said cooking apparatus.

24. Apparatus according to claim 1, wherein the operative temperature is about 300° C.

25. System for controlling the humidity in a chamber for cooking foods comprising a humidity detecting device, said humidity detecting device comprising a capacitive sensor and an oscillating circuit arrangement arranged to convert a capacity variation of said capacitive sensor into an electric frequency variation, said capacitive sensor comprising a pair of armatures facing each others and placed at a defined distance that is adjustable.

26. System according to claim 25, wherein said oscillating circuit arrangement is connected to a frequency-measuring device such as to measure said frequency variation and provide a value of said frequency variation.

27. System according to claim 25, wherein said oscillating circuit arrangement is connected to a timing device such as to measure the period of the signal leaving said oscillating circuit arrangement and to provide a variation value of this period.

28. System according to claim 26, and further comprising a processing unit suitable for processing said value to associate it with a humidity value.

29. System according to claim 25, wherein each armature of said pair of armatures is of steel.

30. System according to claim 25, wherein each armature of said pair of armatures is flat and has a plan shape chosen from a group of geometrical figures comprising: a circle, a regular polygon, an irregular polygon, a rectangle, a square.

31. System according to claim 25, wherein said capacitive sensor comprises a pair of concentric cylindrical armatures that are radially spaced.

32. System according to claim 25, comprising circulating arrangements arranged for introducing and/or extracting primary operating fluid in and/or from said chamber, and a flow promoting device controlled by a processing unit.

33. System according to claim 25, comprising circulating arrangements arranged for introducing and/or extracting primary operating fluid in and/or from the cooking chamber, and a flow regulating device controlled by a processing unit.

* * * * *